US005875854A

United States Patent [19]

Yamamoto et al.

[11] Patent Number: 5,875,854

[45] Date of Patent: Mar. 2, 1999

[54] DOZING SYSTEM FOR BULLDOZER

[75] Inventors: Shigeru Yamamoto; Hidekazu Nagase, both of Hirakata, Japan

[73] Assignee: Komatsu Ltd., Tokyo, Japan

[21] Appl. No.: 76,004

[22] Filed: May 12, 1998

[30] Foreign Application Priority Data

May 15, 1997 [JP] Japan ..... 9-125386

[51] Int. Cl.[6] ..... G06F 7/70; E02F 3/76; E60K 28/16

[52] U.S. Cl. ..... 172/4.5; 701/50

[58] Field of Search ..... 172/4.5, 2, 3, 4; 701/50

[56] References Cited

U.S. PATENT DOCUMENTS

| | | | |
|---|---|---|---|
| 4,282,933 | 8/1981 | Suganami et al. | 172/4.5 |
| 4,630,685 | 12/1986 | Huck, Jr. et al. | 172/7 |
| 5,462,125 | 10/1995 | Stratton et al. | 172/2 X |
| 5,467,829 | 11/1995 | Barton et al. | 172/4.5 |
| 5,694,317 | 12/1997 | Nakagami et al. | 172/4.5 X |

FOREIGN PATENT DOCUMENTS

| | | |
|---|---|---|
| 55-36776 | 9/1980 | Japan . |
| 63-6694 | 2/1988 | Japan . |
| 1-163324 | 6/1989 | Japan . |
| 62-291337 | 12/1989 | Japan . |
| 3-43523 | 2/1991 | Japan . |
| 4-285214 | 10/1992 | Japan . |
| 5-106239 | 4/1993 | Japan . |
| 7-11665 | 1/1995 | Japan . |
| 7-11666 | 1/1995 | Japan . |
| 7-26586 | 1/1995 | Japan . |
| 7-48855 | 2/1995 | Japan . |
| 7-48856 | 2/1995 | Japan . |
| 7-48857 | 2/1995 | Japan . |
| 7-54374 | 2/1995 | Japan . |
| 7-62683 | 3/1995 | Japan . |
| 7-252859 | 10/1995 | Japan . |
| 8-199620 | 8/1996 | Japan . |
| 8-260506 | 10/1996 | Japan . |
| 9-209394 | 8/1997 | Japan . |

*Primary Examiner*—Christopher J. Novosad
*Attorney, Agent, or Firm*—Armstrong, Westerman, Hattori, McLeland & Naughton

[57] ABSTRACT

A dozing system for use in a bulldozer, which is capable of performing an automatic dozing operation, according to working conditions and soil properties in the field. In this system, data on the relationships of the actual traveling distance of the bulldozer with actual tractive force exerted on the blade, with the position of the cutting edge of the blade relative to the ground, with the ratio of the amount of excavated soil loaded on the front surface of the blade to the loading capacity of the front surface of the blade, and with the pitch angle of the blade are stored, and based on the stored data, the blade is controlled so as to assume the desired position.

9 Claims, 11 Drawing Sheets

TRACTIVE FORCE $F_o$
Ls
Lo
La
ACTUAL TRAVELING DISTANCE (L)
Lb
Ld

BLADE CUTTING EDGE POSITION RELATIVE TO THE GROUND $\psi_o$
Ls
Lo
La
ACTUAL TRAVELING DISTANCE (L)
Lb
Ld BLADE LOADING RATIO $Q_o$
Ls
Lo
La
ACTUAL TRAVELING DISTANCE (L)
Lb
Ld PITCH ANGLE $\alpha_0$
Ls
Lo
La
ACTUAL TRAVELING DISTANCE (L)
Lb
Ld

DOZING SYSTEM FOR BULLDOZER

BACKGROUND OF THE INVENTION

1. Field of the Invention

The present invention generally relates to a dozing system well suited for use in bulldozers; and more particularly, to a technique for automating the work cycle of digging, carrying and dumping according to data input by operator teaching.

2. Description of the Relevant Art

Normally, the dozing operation of a bulldozer is manually controlled by the operator. The operator manipulates the blade of a bulldozer by lifting, lowering, tilting and pitching in order to constantly maintain the forces exerted on the blade during digging and carrying of earth, while trying to avoid the running slippage (shoe slippage) of the vehicle body.

Such manually controlled dozing operation requires operator's skill. Moreover, the operator will get tremendous fatigue after frequent operation of the blade, no matter how skillful he is. Up to now, many attempts have been made to solve this problem and some automatic dozing techniques have been, in fact, put to practical use. One of such automatic dozing techniques is disclosed in Japanese Patent Examined Publication No. 55-36776 (1980), in which the lift amount of the blade is controlled according to the forces exerted on the blade. Another example, which is disclosed in Japanese Patent Unexamined Publication No. 7-48855 (1995), proposes automatic dozing which is performed by controlling the position of the cutting edge of the blade relative to the ground.

The conventional automatic dozing techniques including the above are not designed to take into account factors (such as, working conditions and soil properties in the field); and therefore, often encounter difficulties in meeting particular field conditions.

The objects of the present invention are to overcome the above discussed problems of the conventional art and to provide a dozing system for bulldozers which is capable of performing appropriate automatic dozing operation according to working conditions and soil properties in the field.

SUMMARY OF THE INVENTION

The above objects can be achieved by a dozing system for use in a bulldozer according to the invention, which comprises:

(a) memory means for storing data on actual tractive force exerted on a blade, on the position of the cutting edge of the blade relative to the ground, on the ratio of the amount of excavated soil loaded on the front surface of the blade to the loading capacity of the front surface of the blade and on the pitch angle of the blade, the data being respectively stored in relation to the actual traveling distance of the bulldozer, and (b) blade controller means for controlling the blade according to the data stored in the memory means so as to assume a desired position.

According to the invention, the relationships of the actual traveling distance of the bulldozer with actual tractive force exerted on the blade; with the cutting edge position of the blade relative to the ground; with the ratio of the amount of excavated soil loaded on the front surface of the blade to the loading capacity of the front surface of the blade (hereinafter referred to as "blade loading ratio"); and with the pitch angle of the blade are stored beforehand in the memory means.

Based on the prestored data, the position of the blade is controlled in actual dozing operation. Preferably, the data are input to the memory means through the teaching operation of the bulldozer. Accordingly, the relationship data are prepared based on manual dozing performed by the operator and actual dozing operation is carried out according to the prepared data, so that a digging start point, a switching point at which operation is switched from digging to earth carrying, dumping manner, a dumping point and a series of blade control during digging and earth carrying operations can be automatically determined so as to conform to the particular working condition and soil property of the field. Preferably, the digging start point disclosed herein is the position at which the cutting edge position of the blade reaches the ground after the bulldozer has been put in operation. Preferably, the switching point at which operation is switched from digging to earth carrying is the position where the front surface of the bulldozer has become full up with soil and the pitch angle of the blade comes to correspond to an earth carrying position; the dumping start point is the position where blade lifting or pitch dumping is performed during earth carrying operation; and the dumping point is the position where backward driving of the bulldozer has started. It should be noted that the teaching operation performed by the operator may be performed prior to actual dozing operation or performed by manually intervening in automatic dozing operation.

The data stored in the memory means are prepared in such a way that the actual tractive force, blade cutting edge position, blade loading ratio and blade pitch angle which correspond to a particular actual traveling distance are respectively determined by averaging measurements obtained at actual traveling distances within a narrow measuring range across said particular actual traveling distance. With this arrangement, hunting in the blade control can be prevented even if there are slight variations in the data input by the operator teaching.

According to the invention, the data on the actual tractive force in relation to the actual traveling distance of the bulldozer are preferably set as target tractive force values to be used in blade lift control for making the actual tractive force exerted on the blade equal to target tractive force. The data on the blade cutting edge position in relation to the actual traveling distance of the bulldozer are preferably set as target blade cutting edge position values to be used in blade smoothing compensation control for making the actual cutting edge position of the blade relative to the ground equal to a target blade cutting edge position. The data on the blade pitch angle in relation to the actual traveling distance of the bulldozer are preferably set as target pitch angle values to be used in blade pitch control for making the actual pitch angle of the blade when the bulldozer is in a dumping mode equal to a target pitch angle. In addition, the data on the blade loading ratio in relation to the actual traveling distance of the bulldozer are preferably set as supplementary data to be used in the above blade lift control or blade pitch control.

It is preferable to correct the data stored in the memory means by learning. With this arrangement, even if the working conditions or soil property frequently changes as dozing operation proceeds, appropriate teaching can be consistently performed, accommodating the changes.

DETAILED DESCRIPTION OF THE PREFERRED EMBODIMENTS

Referring now to the accompanying drawings, a dozing system for a bulldozer constructed according to a preferred embodiment of the invention will be described.

Figure 1:
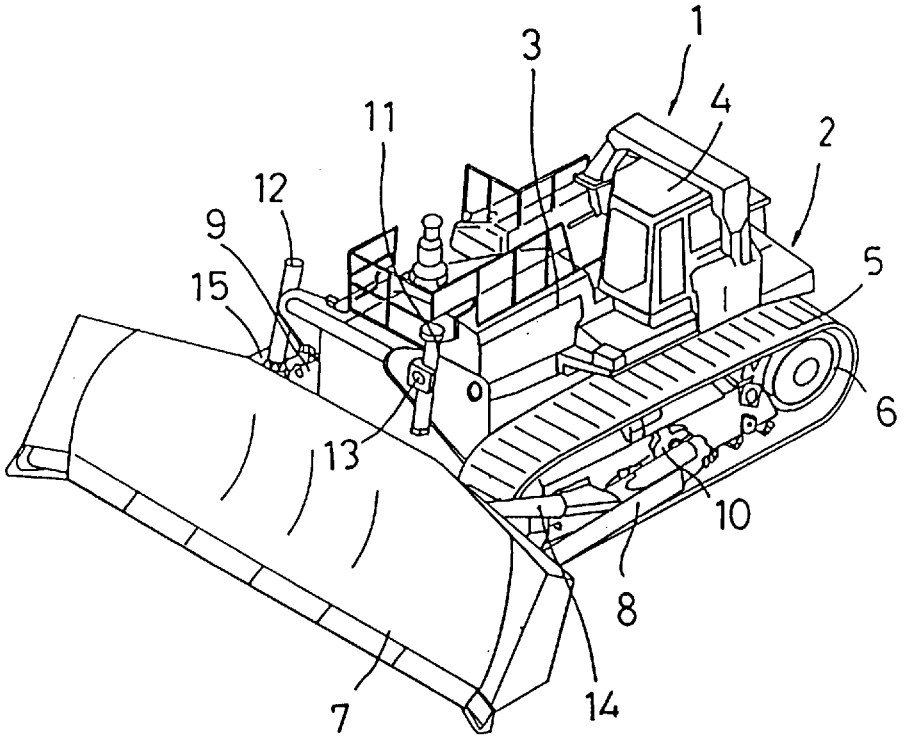
FIG. 1 is a perspective outside view of a bulldozer.
Figure 2:
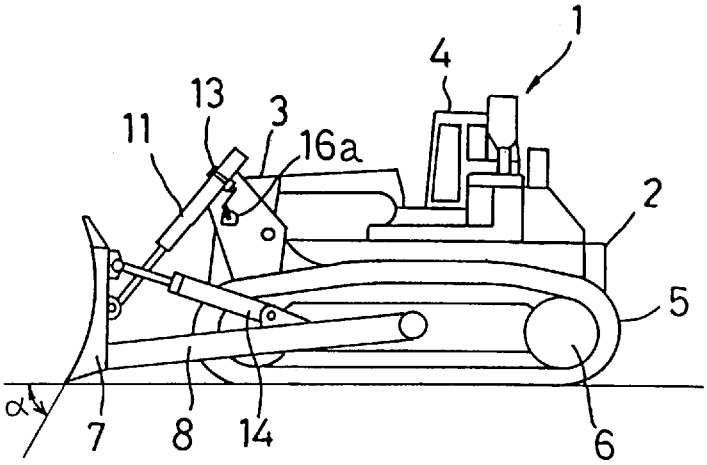
FIG. 2 is a side view of the bulldozer.

FIGS. 1 and 2 show a perspective outside view and side view, respectively, of a bulldozer 1 to which a dozing system according to one embodiment of the invention is adapted.

In this embodiment, the bulldozer 1 has a vehicle body 2 on which a bonnet 3 for housing an engine 20 (described later) and a cab 4 for the operator who drives the bulldozer 1 are provided. Disposed on both right and left sides of the vehicle body 2 when viewed in the forward moving direction of the vehicle body 2 are crawler belts 5 (the crawler belt on the right side is not shown in the drawing) for driving the vehicle body 2 so as to travel forwardly and reversely and turn. The crawler belts 5 are respectively independently driven by driving power transmitted from the engine 20 with the aid of their corresponding sprockets 6.

There is provided a blade 7 in front of the vehicle body 2. The blade 7 is supported at the leading ends of right and left straight frames 8, 9 the base ends of which are, in turn, pivotally supported at the sides of the vehicle body 2 through trunnions 10 (the trunnion on the right side is not shown in the drawing) such that the blade 7 can be lifted or lowered in relation to the vehicle body 2. A pair of blade lift cylinders 11, 12 are disposed in front of both sides of the vehicle body 2, for lifting or lowering the blade 7. The base ends of the blade lift cylinders 11, 12 are supported by their respective yokes 13 that are rotatably mounted on the vehicle body 2, while the other ends of the cylinders 11, 12 are pivotally supported on the back face of the blade 7. For controlling the blade 7 so as to assume the digging position, pitch dump position or pitch back position (these positions are to be described later), blade pitch cylinders 14, 15 are provided between the blade 7 and the right straight frame 8 and between the blade 7 and the left straight frame 9 respectively.

The vehicle body 2 is provided with yoke angle sensors 16*a*, 16*b* (the right yoke angle sensor is not shown in FIG. 2) for detecting the pivoting angle of each yoke 13, that is, the pivoting angle of each of the blade lift cylinders 11, 12. The blade lift cylinders 11, 12 are provided with stroke sensors 19*a*, 19*b* (shown in FIG. 3 only), respectively, for detecting the strokes of the blade lift cylinders 11, 12.

Figure 3:
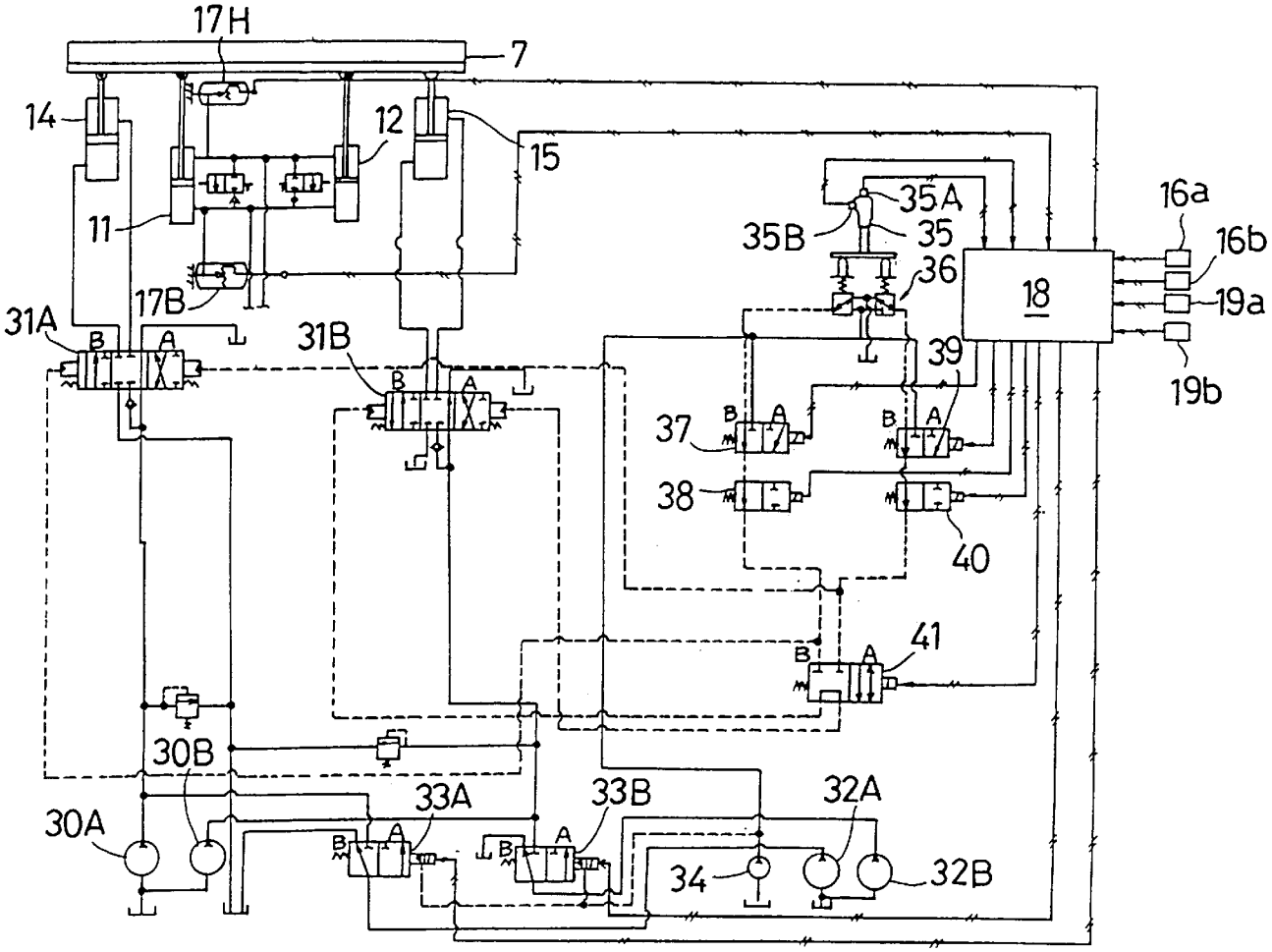
FIG. 3 is a hydraulic circuit diagram of a pitch operation circuit for the bulldozer.

As seen from the hydraulic circuit diagram of FIG. 3, hydraulic pressure sensors 17H, 17B for respectively detecting hydraulic pressures on the respective heads and bottoms of the blade lift cylinders 11, 12 are disposed in a hydraulic pipe line for providing hydraulic pressure to the heads and bottoms of the blade lift cylinders 11, 12. The outputs of the yoke angle sensors 16*a*, 16*b*, stroke sensors 19*a*, 19*b* and hydraulic pressure sensors 17H, 17B are entered in a controller 18 consisting of a microcomputer.

Figure 4:
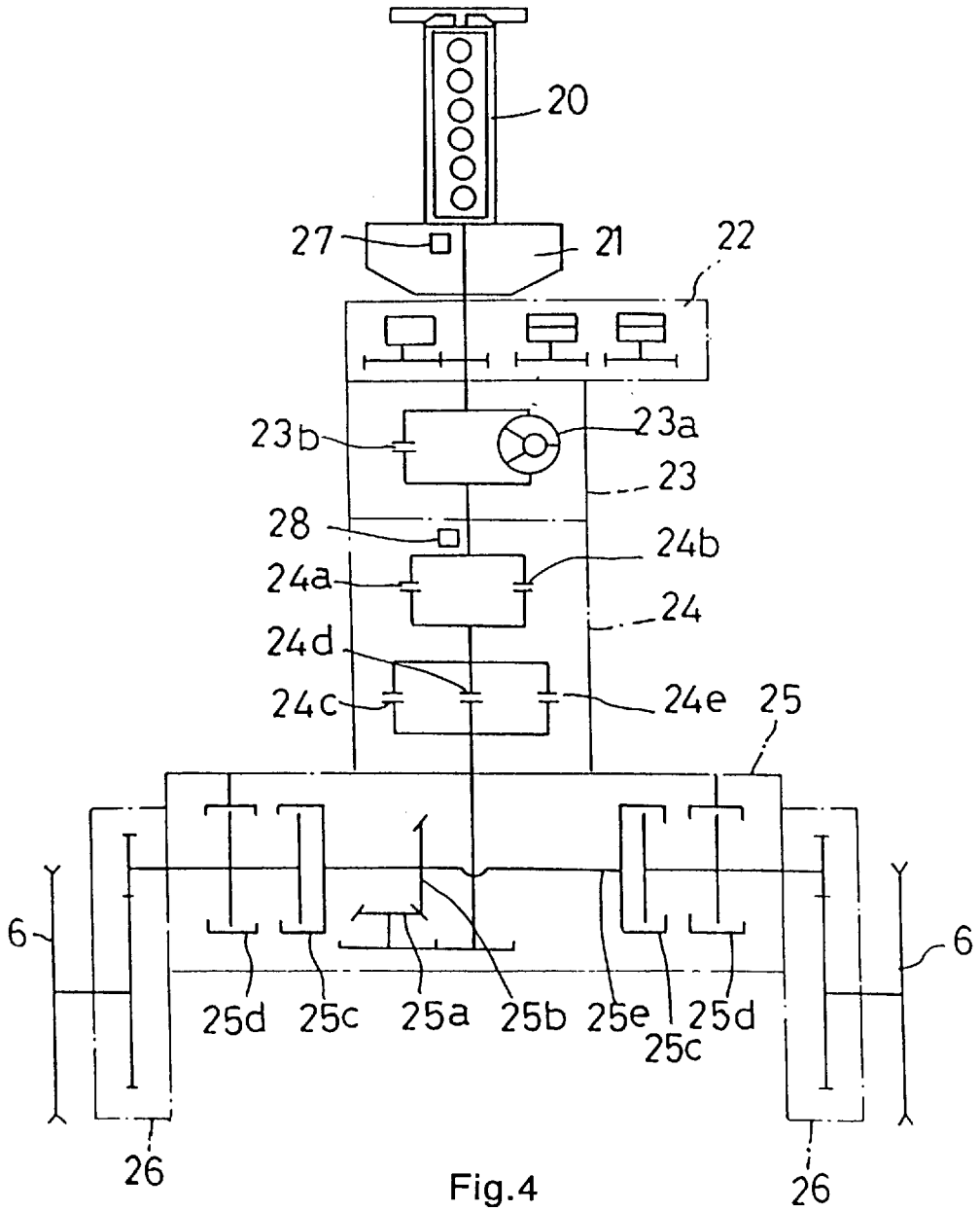
FIG. 4 is a skeleton diagram of a power transmission system.

Referring to FIG. 4 which shows a power transmission system, the rotary driving power of the engine 20 is transmitted to a damper 21 and a PTO 22 for driving various hydraulic pumps including an implement operating hydraulic pump and then to a torque converter unit 23 having a torque converter 23*a* and a lock-up clutch 23*b*. The rotary driving power is then transmitted from the output shaft of the torque converter unit 23 to a transmission 24 (e.g., wet multiple disc clutch type planetary gear transmission) which has an input shaft connected to the output shaft of the torque converter unit 23. The transmission 24 comprises a forward drive clutch 24*a*, reverse drive clutch 24*b* and first to third speed clutches 24*c*, 24*d*, 24*e*, so that the output shaft of the transmission 24 is rotated in three speed ranges in both forward drive and reverse drive. The rotary driving power from the output shaft of the transmission 24 is transmitted to paired right and left final reduction gear mechanisms 26 through a steering system 25 to power the respective sprockets 6 for running the crawler belts 5 (not shown in FIG. 4). The steering system 25 has a transverse shaft 25*e* having a pinion 25*a*, a bevel gear 25*b*, paired right and left steering clutches 25*c* and steering brakes 25*d*. Reference numeral 27 designates an engine speed sensor for detecting the engine speed of the engine 20 whereas reference numeral 28 designates a torque converter output shaft revolution sensor for detecting the revolution speed of the output shaft of the torque converter unit 23.

Engine speed data that is representative of the engine speed of the engine 20 and sent from the engine speed sensor 27; revolution data that is representative of the revolution speed of the output shaft of the torque converter unit 23 and sent from the torque converter output shaft revolution sensor 28; and a lock-up (L/U) / torque converting (T/C) selection instruction that is representative of whether or not the torque converter 23 is to be locked up and sent from a lock-up shift switch (not shown); are all input to the controller 18 (see FIG. 3).

Reference is now made to FIG. 3 for explaining a pitch operation circuit for operating the blade 7 with the blade pitch cylinders 14, 15 according to the embodiment. It should be noted that a lift operation circuit for operating the blade 7 with the blade lift cylinders 11, 12 is omitted from this hydraulic circuit.

In the hydraulic circuit diagram, a first direction control valve 31A is connected to the discharge pipe line of a fixed capacity type hydraulic pump 30A for supplying hydraulic pressure to the left blade pitch cylinder 14 while a second direction control valve 31B is connected to the discharge pipe line of a fixed capacity type hydraulic pump 30B for supplying hydraulic pressure to the right blade pitch cylinder 15. The discharge pipe line of an assist hydraulic pump 32A is connected to the discharge pipe line of the hydraulic pump 30A through an assist solenoid valve 33A. The discharge pipe line of an assist hydraulic pump 32B is connected to the discharge pipe line of the hydraulic pump 30B through an assist solenoid valve 33B.

The discharge pipe line of a pilot pump 34 is connected to a pilot control valve 36 for an operation lever 35. The pilot control valve 36 is connected to a left tilt limiting valve 38 through a pitch back control valve 37 and is connected to a right tilt limiting valve 40 through a pitch dump control valve 39. The pilot control valve 36 is also connected to the second direction control valve 31B through a pitch/tilt switching solenoid valve 41 and is connected to the first direction control valve 31A through the pitch back control valve 37, left tilt limiting valve 38, pitch dump control valve 39 and right tilt limiting valve 40.

The above operation lever 35 is provided with a pitch back change-over switch 35A and a pitch dump change-over switch 35B, these switches 35A, 35B being connected to the controller 18.

The output signal of the controller 18 is input to the assist solenoid valves 33A, 33B, pitch back control valve 37, pitch dump control valve 39, left tilt limiting valve 38, right tilt limiting valve 40 and pitch/tilt switching solenoid valve 41 to control these valves.

After a blade pitch back instruction has issued from the controller 18, the pitch back control valve 37 is shifted to Position A and the pitch/tilt switching solenoid valve 41 is shifted to Position A. In the mean time, an instruction signal is sent from the controller 18 to the assist solenoid valves 33A, 33B so that these valves 33A, 33B are shifted to Position A. Therefore, the flow of pressure oil discharged from the assist hydraulic pumps 32A, 32B joins the flow in the discharge pipe line of the hydraulic pumps 30A, 30B. At that time, the pilot pressure of the pilot pump 34 is exerted on the operation section of the first direction control valve 31A through the pitch back control valve 37 and the left tilt limiting valve 38 and exerted on the operation section of the second direction control valve 31B through the pitch back control valve 37, the left tilt limiting valve 38 and the pitch/tilt switching solenoid valve 41. This allows the first direction control valve 31A and the second direction control valve 31B to be shifted to Position B so that the pressure oil discharged from the hydraulic pump 30A is flowing into the head chamber of the blade pitch cylinder 14 through the first direction control valve 31A while the pressure oil discharged from the hydraulic pump 30B is flowing into the head chamber of the blade pitch cylinder 15 through the second direction control valve 31B. In this way, the blade pitch cylinders 14, 15 are simultaneously shortened and the blade 7 promptly pitches back (backward inclination) so that the position of the blade 7 is changed from a digging position to a carrying position.

When the controller 18 has output a blade pitch dump instruction, the pitch dump control valve 39 is shifted to Position A and the pitch/tilt switching solenoid valve 41 is shifted to Position A. Meanwhile, an instruction signal from the controller 18 is input to the assist solenoid valves 33A, 33B so that they are shifted to Position A. This allows the flow of pressure oil discharged from the assist hydraulic pumps 32A, 32B to join the flow in the discharge pipe line of the hydraulic pumps 30A, 30B. At that time, the pilot pressure from the pilot pump 34 is exerted on the operation section of the first direction control valve 31A through the pitch dump control valve 39 and the right tilt limiting valve 40 and exerted on the operation section of the second direction control valve 31B through the pitch back control valve 37, the left tilt limiting valve 38 and the pitch/tilt switching solenoid valve 41. This allows the first direction control valve 31A and the second direction control valve 31B to be shifted to Position A so that the pressure oil discharged from the hydraulic pump 30A is flowing into the bottom chamber of the blade pitch cylinder 14 through the first direction control valve 31A while the pressure oil discharged from the hydraulic pump 30B is flowing into the bottom chamber of the blade pitch cylinder 15 through the second direction control valve 31B. In this way, the blade pitch cylinders 14,15 are simultaneously elongated and the blade 7 promptly pitches for dumping (forward inclination) so that the position of the blade 7 is changed from a carrying position to a dumping position.

Figure 5:
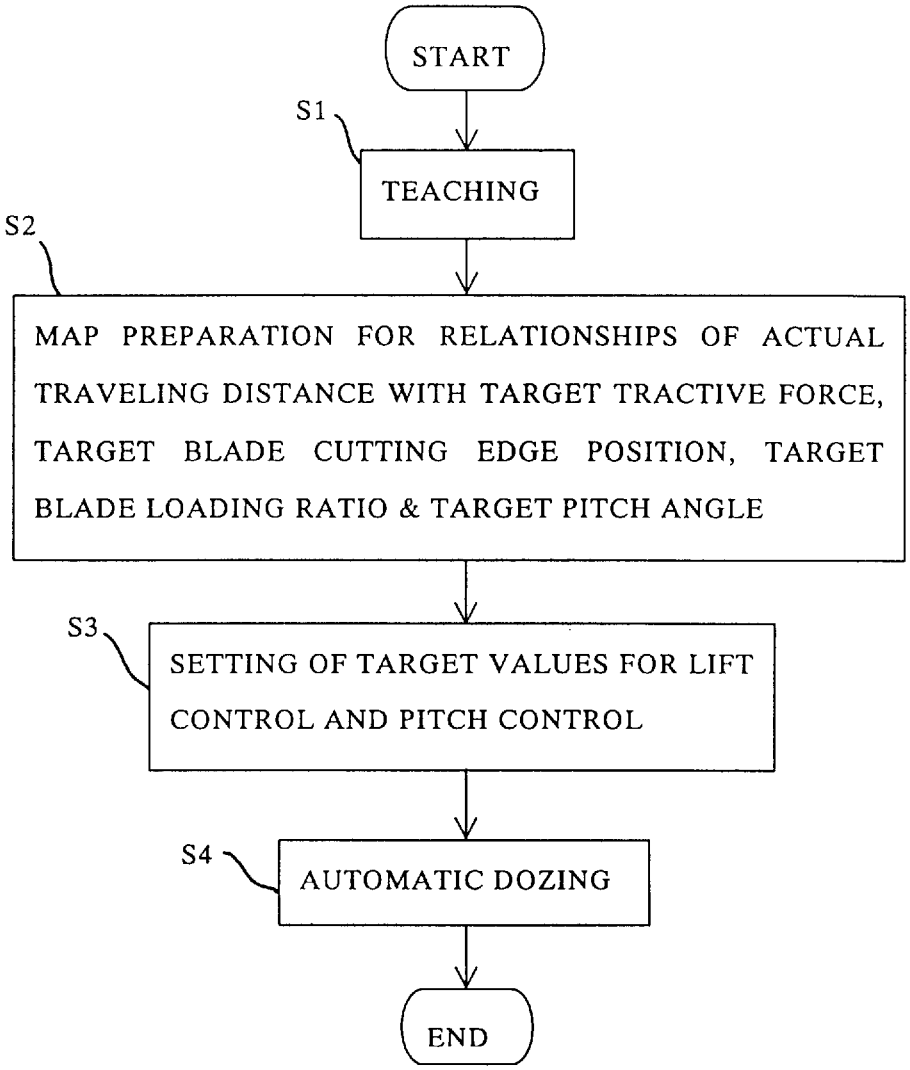
FIG. 5 is a flow chart of dozing operation.

In the bulldozer 1 of this embodiment, teaching of dozing is first performed by the operator and automatic dozing is then performed according to the data obtained from the teaching. Now, reference is made to the flow chart of FIG. 5 to explain the process of dozing operation according to the embodiment.

S1: Manual dozing (teaching operation) is performed by the operator.

S2: Based on data obtained by sensing during the teaching operation, four kinds of maps (see FIG. 6), which are to be used in the position control for the blade 7 performed when the bulldozer 1 is in the automatic driving mode, are stored as initial values in the memory of the controller 18. The actual traveling distance L of the bulldozer 1 is obtained by integration of actual vehicle speed detected by, for example, a Doppler sensor or integration of actual vehicle speed determined from the revolution speed of the sprockets for the crawler belts. Alternatively, the actual traveling distance L may be measured by positioning/measurement means designed to receive electric waves from the satellites of GPS (Global Positioning System) to calculate the distance, utilizing the real time kinematics method or the differential method.

Figure 6:
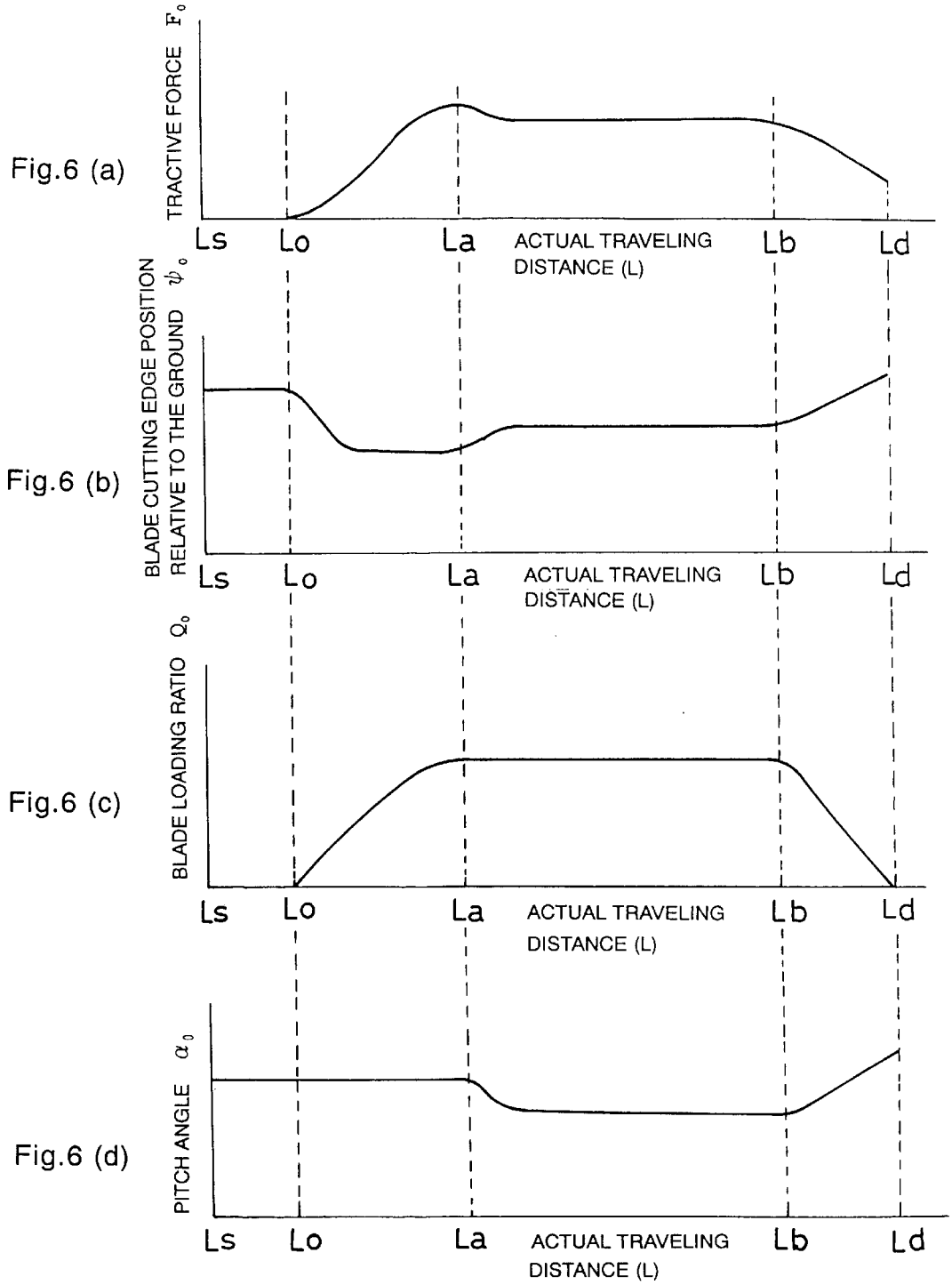
FIGS. 6(*a*) to 6(*d*) are graphs each representing a map used in blade position control that is performed when the bulldozer is in an automatic driving mode.

① Map showing the relationship between target tractive force $F_0$ and actual traveling distance L (FIG. 6(*a*))

The target tractive force $F_0$ varies according to the driving mode (automatic digging mode, automatic earth carrying mode, automatic dumping mode) of the bulldozer 1. More specifically, when the bulldozer 1 is in the digging mode, the target tractive force $F_0$ gradually increases after the bulldozer 1 has reached a digging start point $L_0$ and then becomes a substantially constant value. In the earth carrying mode, the target tractive force $F_0$ gradually decreases after the bulldozer 1 has reached a carrying switching point $L_a$ and then becomes a constant value. In the dumping mode, it constantly decreases.

② Map showing the relationship between target blade cutting edge position relative to the ground $\psi_0$ and actual traveling distance L (FIG. 6(*b*))

The target position $\psi_0$ for the cutting edge of the blade relative to the ground also varies according to the driving mode (automatic digging mode, automatic earth carrying mode, automatic dumping mode) of the bulldozer. The target blade cutting edge position $\psi_0$ is a constant value after the bulldozer started traveling until it reaches the digging start point $L_0$. When the bulldozer 1 is in the digging mode, the value of the target blade cutting edge position $\psi_0$ gradually decreases after the bulldozer 1 has reached the digging start point $L_0$ and then becomes a constant value. In the earth carrying mode, it gradually increases and then becomes a constant value. In the dumping mode, it constantly increases.

③ Map showing the relationship between target blade loading ratio $Q_0$ and actual traveling distance L (FIG. 6(*c*))

The target ratio $Q_0$ of the amount of excavated soil loaded on the front surface of the blade to the loading capacity of the front surface of the blade also varies according to the driving mode (automatic digging mode, automatic earth carrying mode, automatic dumping mode) of the bulldozer. When the bulldozer 1 is in the digging mode, the target blade loading ratio $Q_0$ gradually increases after the bulldozer 1 has reached the digging start point $L_0$. In the earth carrying mode, it is a constant value. In the dumping mode, it constantly decreases.

④ Map showing the relationship between target pitch angle $\alpha_0$ and actual traveling distance L (FIG. 6(*d*))

The target pitch angle $\alpha_0$ also varies according to the driving mode (automatic digging mode, automatic earth carrying mode, automatic dumping mode) of the bulldozer. During the time after the bulldozer 1 starts traveling until it reaches the digging start point $L_0$ and when the bulldozer 1 is in the digging mode, the target pitch angle $\alpha_0$ is a constant value. In the earth carrying mode, the target pitch angle $\alpha_0$ gradually decreases after the bulldozer 1 has reached the carrying switching point $L_a$ and then become a constant value. In the dumping mode, it constantly increases.

Figure 7:
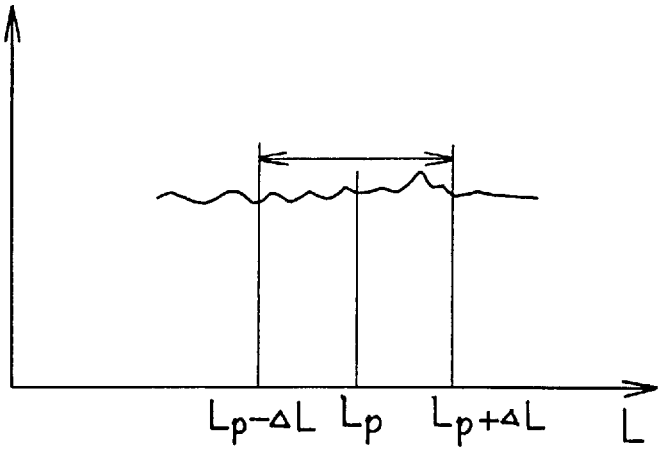
FIG. 7 is a diagram used to explain preparation of map data.

In the preparation of these maps, it is preferable that the target tractive force $F_0$, target blade cutting edge position $\psi_0$, target blade loading ratio $Q_0$ and target pitch angle $\alpha_0$ which correspond to a particular actual traveling distance $L_P$ are respectively determined from the average of measurements obtained at actual traveling distances within the narrow measuring range of $L_P-\Delta L$ to $L_P+\Delta L$ which is set across the particular actual traveling distance $L_P$ as shown in FIG. 7.

In these maps thus prepared, the position where the blade cutting edge position has reached the ground level (G. L) is set as the digging start point $L_0$; the position where the front surface of the blade becomes full of excavated soil and the pitch angle of the blade comes to correspond to the earth carrying position is set as the carrying switching point $L_a$; the position where blade lifting or pitching for dumping has started is set as the dumping start point $L_b$; and the position where backward driving has started is set as a dumping point $L_d$.

S3: Target tractive force values to be used in the blade lift control (load control) are set according to the target tractive force $F_0$—actual traveling distance L relationship map ①. Target blade cutting edge position values to be used in the blade smoothing compensation control are set according to the target blade cutting edge position $\psi_0$—actual traveling distance L relationship map ②. Target pitching angle values to be used in the blade pitch control are set according to the target pitch angle $\alpha_0$—actual traveling distance L relationship map ④. The target blade loading ratio $Q_0$—actual traveling distance L relationship map ③ is used as supplementary data in the blade lift control and the blade pitch control.

S4: After target values for the blade lift control, blade smoothing compensation control and blade pitch control have been set, automatic dozing is performed with these target values.

In the automatic dozing operation, the blade lift control and blade smoothing compensation control are carried out in the following way.

First, the difference $\Delta F$ between the target tractive force $F_0$ and the actual tractive force and the difference $\Delta\psi$ between the target blade cutting edge position $\psi_0$ and a moving average straight frame absolute angle $\psi_2$ are obtained. It should be noted that the moving average straight frame absolute angle $\psi_2$ is obtained from the moving average of sequential data on the straight frame absolute angle detected over a specified time period and that the straight frame absolute angle is obtained from a straight frame relative angle (the average of the angles of the right and left straight frames 8, 9 relative to the vehicle body 2) and the inclination angle of the vehicle body 2. Then, it is determined from these difference values $\Delta F$, $\Delta\psi$ whether or not running slippage has occurred. The program then proceeds to either of the following steps according to the result of the determination.

I. If an occurrence of running slippage is detected, a lift operation amount $Q_S$ for lifting the blade 7 is obtained from a slippage control characteristic map (not shown) in order to eliminate the running slippage by reducing the load of excavated soil exerted on the blade 7.

II. If no running slippage is detected, lift operation amounts $Q_1$, $Q_2$ are obtained.

Figure 8:
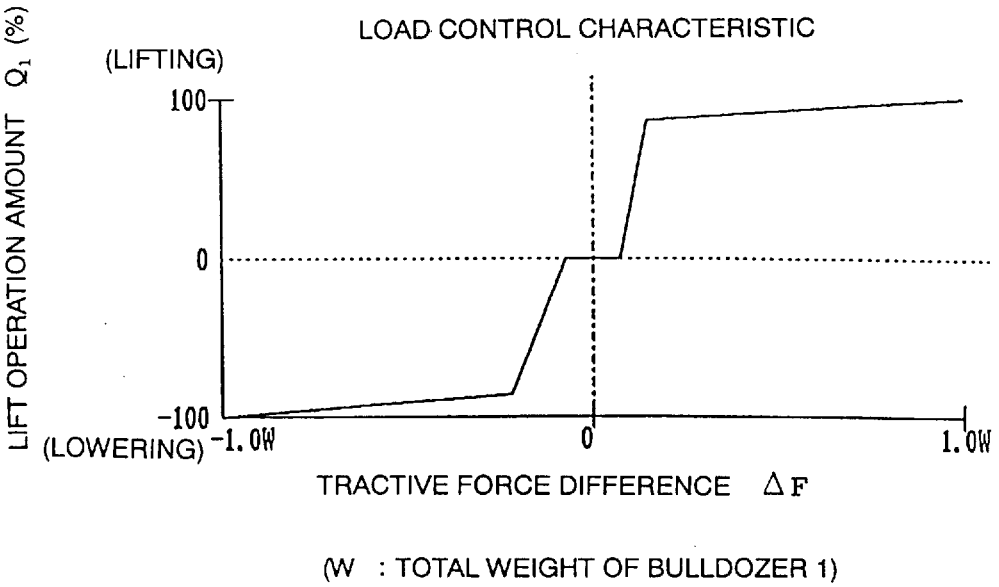
FIG. 8 is a graph of a load control characteristic map.

(1) A lift operation amount $Q_1$ for lifting or lowering the blade 7 such that an actual tractive force after correction F (which is obtained by subtracting the load correction value which corresponds to the inclination angle of the vehicle body 2 from the actual tractive force) becomes coincident with the target tractive force $F_0$ is obtained from the load control characteristic map shown in FIG. 8, using the difference $\Delta F$ between the target tractive force $F_0$ and the actual tractive force after correction F.

Figure 9:
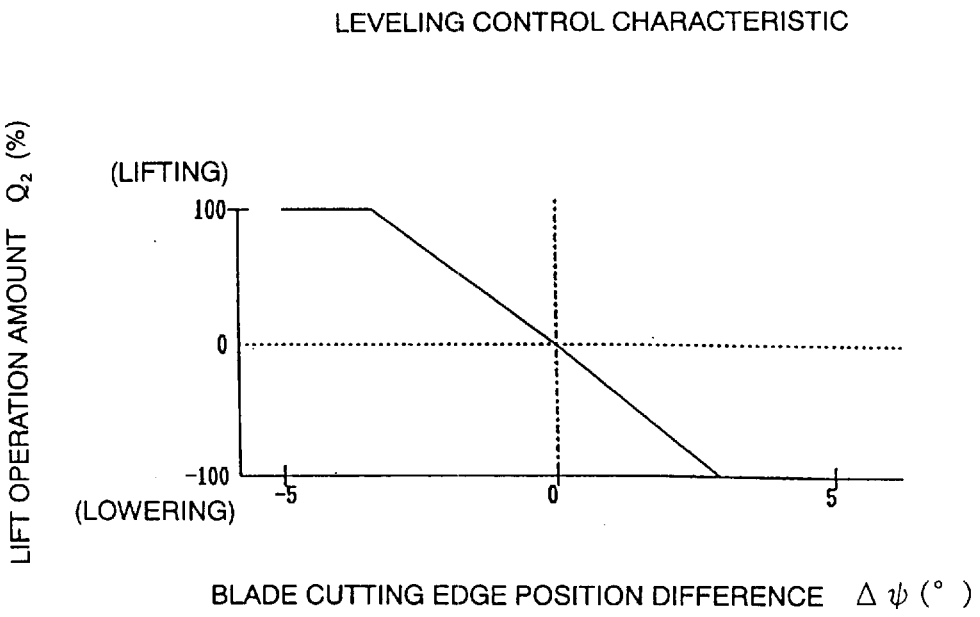
FIG. 9 is a graph of a leveling control characteristic map.

(2) A lift operation amount $Q_2$ for lifting or lowering the blade 7 such that the moving average straight frame absolute angle $\psi_2$ becomes coincident with the target blade cutting edge position $\psi_0$ is obtained from the leveling control characteristic map shown in FIG. 9, using the difference $\Delta\psi$ between the target blade cutting edge position $\psi_0$ and the moving average straight frame absolute angle $\psi_2$.

Figure 10:
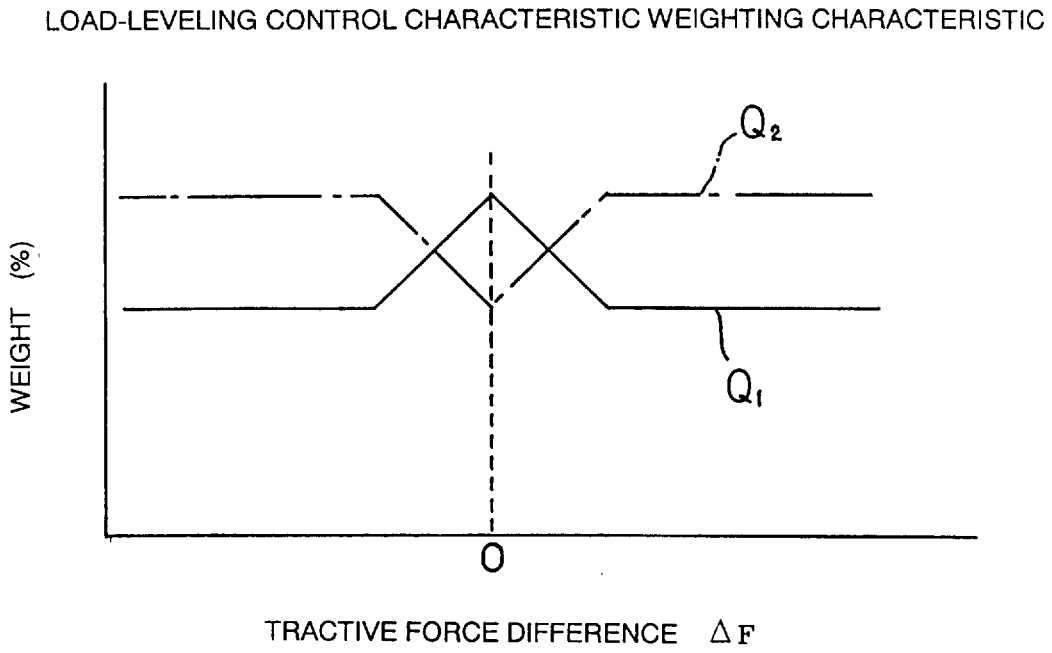
FIG. 10 is a graph of a load-leveling control weighting characteristic map.

(3) A lift operation amount $Q_T$ is obtained by calculating the sum of the lift operation amounts $Q_1$, $Q_2$ which have been respectively assigned weights. These weights are obtained from the load-leveling control weighting characteristic map shown in FIG. 10, using the tractive force difference $\Delta F$.

After the lift operation amounts $Q_S$, $Q_T$ have been thus obtained, these amounts $Q_S$, $Q_T$ are supplied to the blade lift cylinder controller for controlling the blade lift cylinders 11, 12 to operate the blade lift cylinders 11, 12 through a lift valve actuator and a lift cylinder operation valve, according to the amounts $Q_S$, $Q_T$, so that the desired control to lift or lower the blade 7 is performed.

The blade pitch control is performed during automatic dumping operation for heaping up soil into a mound. Specifically, when the actual traveling distance L has reached the dumping start point $L_b$, the pitch control for the blade is executed according to the map shown in FIG. 6(*d*).

Figure 11:
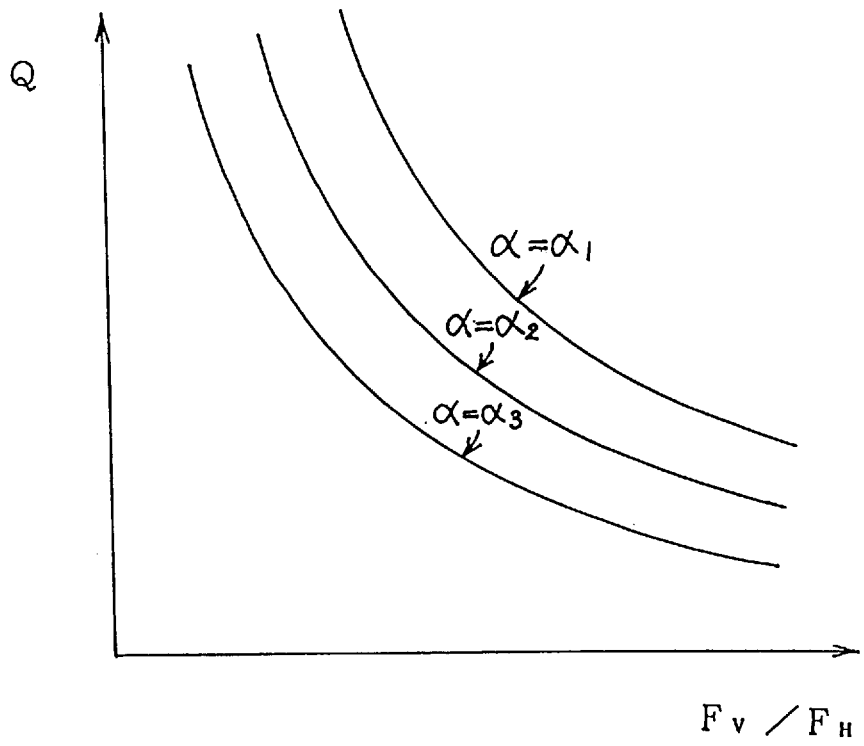
FIG. 11 is a graph showing the relationship between the blade loading ratio Q and the ratio $F_V/F_H$.

The target blade loading ratio $Q_0$—actual traveling distance L relationship map is used as supplementary data in the blade lift control or the blade pitch control. The blade loading ratio Q is calculated from the ratio ($F_V/F_H$) of vertical reaction force $F_V$ (the pressing force of the blade lift cylinders 11, 12) to horizontal reaction force $F_H$ (actual tractive force after correction) and pitch angle $\alpha$, since it correlates with the ratio $F_V/F_H$, with the pitch angle $\alpha$ serving as a parameter (see FIG. 11). Therefore, more accurate dozing control can be ensured by correcting the prestored carrying switching point $L_a$ and dumping start point $L_b$ with the value of the blade loading ratio Q, that is, the value of the ratio $F_V/F_H$.

While the teaching operation in this embodiment is manually performed by the operator prior to actual automatic dozing, it may be performed by manual intervention by the operator during automatic dozing operation.

In this embodiment, the data obtained by the teaching operation is preferably corrected by learning. With this arrangement, even if working conditions or soil property varies frequently as dozing operation proceeds, teaching can be appropriately performed, accommodating the changes.

We claim:

1. A dozing system for a bulldozer, which comprises:

(a) memory means for storing data on actual tractive force exerted on a blade, on the position of the cutting edge of the blade relative to the ground, on the ratio of the amount of excavated soil loaded on the front surface of the blade to the loading capacity of the front surface of the blade, and on the pitch angle of the blade, said data being respectively stored in relation to the actual traveling distance of the bulldozer, and (b) blade controller means for controlling the blade according to said data stored in the memory means so as assume a desired position.

2. The dozing system for a bulldozer according to claim 1, wherein said data are respectively stored in the memory means through teaching operation of the bulldozer.

3. The dozing system for a bulldozer according to claim 2, wherein said data stored in the memory means are prepared in such a way that the actual tractive force, blade cutting edge position, blade loading ratio and blade pitch angle which correspond to a particular actual traveling distance are respectively determined by averaging measurements obtained at actual traveling distances within a measuring range across said particular actual traveling distance.

4. The dozing system for a bulldozer according to claim 1, wherein said data on the actual tractive force in relation to the actual traveling distance of the bulldozer stored in the memory means are set as target tractive force values to be used in blade lift control for making actual tractive force exerted on the blade equal to target tractive force.

5. The dozing system for a bulldozer according to claim 4, wherein said data on the blade loading ratio in relation to the actual traveling distance of the bulldozer stored in the memory means are set as supplementary data to be used in the blade lift control.

6. The dozing system for a bulldozer according to claim 1, wherein said data on the blade cutting edge position in relation to the actual traveling distance of the bulldozer stored in the memory means are set as target blade cutting edge position values to be used in blade smoothing compensation control for making the actual cutting edge position of the blade equal to a target blade cutting edge position.

7. The dozing system for a bulldozer according to claim 1, wherein said data on the blade pitch angle in relation to the actual traveling distance of the bulldozer stored in the memory means are set as target pitch angle values to be used in blade pitch control for making the pitch angle of the blade when the bulldozer is in a dumping mode equal to a target pitch angle.

8. The dozing system for a bulldozer according to claim 7, wherein said data on the blade loading ratio in relation to the actual traveling distance of the bulldozer are set as supplementary data to be used in the blade pitch control.

9. The dozing system for a bulldozer as in any one of the preceding claims, wherein said data stored in the memory means are corrected by learning.

* * * * *